US006189611B1

(12) United States Patent
Kasevich

(10) Patent No.: US 6,189,611 B1
(45) Date of Patent: Feb. 20, 2001

(54) RADIO FREQUENCY STEAM FLOOD AND GAS DRIVE FOR ENHANCED SUBTERRANEAN RECOVERY

(75) Inventor: Raymond S. Kasevich, Mount Washington, MA (US)

(73) Assignee: KAI Technologies, Inc., Great Barrington, MA (US)

( * ) Notice: Under 35 U.S.C. 154(b), the term of this patent shall be extended for 0 days.

(21) Appl. No.: 09/275,612

(22) Filed: Mar. 24, 1999

(51) Int. Cl.[7] ..... E21B 36/00; E21B 43/24

(52) U.S. Cl. ..... 166/248; 166/272.1; 166/302; 166/272.3

(58) Field of Search ..... 166/272.1, 272.3, 166/302, 248, 65.1

(56) References Cited

U.S. PATENT DOCUMENTS 4,638,863 * 1/1987 Wilson ..... 166/248
5,109,927 * 5/1992 Supernaw et al. ..... 166/248
5,199,488 * 4/1993 Kasevich et al. ..... 166/248
5,236,039 * 8/1993 Edelstein et al. ..... 166/248
5,293,936 * 3/1994 Bridges ..... 166/248
5,370,477 * 12/1994 Bunin et al. ..... 166/248

* cited by examiner

*Primary Examiner*—William Neuder
(74) *Attorney, Agent, or Firm*—Fish & Richardson P.C.

(57) ABSTRACT

A method and system is provided for autogenic generation of a subterranean fluid flow, such as may be applied, for example, to enhance oil recovery or pollution abatement. In general, the method and system includes placing an electromagnetic apparatus down the borehole of an applicator well, and radiating energy into a permeable formation to achieve displacement flooding effects.

50 Claims, 5 Drawing Sheets

RADIO FREQUENCY STEAM FLOOD AND GAS DRIVE FOR ENHANCED SUBTERRANEAN RECOVERY

BACKGROUND OF THE INVENTION

The invention relates to providing subterranean fluid flow within a permeable formation.

In the oil production industry, an oil well is typically drilled hundreds or thousands of feet to reach a permeable formation containing an oil reservoir. In this context, a permeable formation refers to any subterranean media through which a fluid may flow, including but not limited to soils, sands, shales, porous rocks and faults and channels within non-porous rocks. When techniques are used to increase or concentrate the amount of fluid in an area of a reservoir, that area is commonly referred to as an enhanced pool.

During the primary stage of oil production, the forces of gravity and the naturally existing pressure in a reservoir cause a flow of oil to the production well. Thus, primary recovery refers to recovery of oil from a reservoir by means of the energy initially present in the reservoir at the time of discovery. Over a period of time, the natural pressure of a reservoir will decrease as oil is taken from the well. In general, as the pressure differential between the reservoir and the well decreases, the flow of oil to the well also decreases. Eventually, the flow of oil to the well will decrease to a point where the amount of oil available from the well no longer justifies the costs of production, including the costs of removing and transporting the oil. Many factors may contribute to this diminishing flow, including the volume and pressure of the oil reservoir, the structure, permeability and ambient temperature of the formation, and the viscosity, composition and other characteristics of the oil.

As the amount of available oil decreases in the primary stage of recovery, it may be desirable to enhance production through the use of secondary or tertiary stages of production. Secondary recovery generally refers to the injection of secondary energy into the reservoir to enhance oil flow to a production well. Secondary recovery methods include, for example, injecting materials such as steam, air or natural gas into a reservoir to displace oil in the direction of a production well.

Tertiary recovery generally refers to processes that attempt to recover oil beyond the conventional primary and secondary recovery methods. Tertiary processes include such techniques as miscible fluid displacement, microemulsion flooding, thermal methods, and chemical flooding methods. Such methods may be technologically sophisticated and entail considerable financial risk because of the level of financial investment required.

One method of enhancing oil production is to inject a solvent into a reservoir that is miscible both in oil and in the brine waters found in the reservoir. As an example, natural gas may be injected into a reservoir at a sustained pressure to cause the gas to diffuse into the reservoir and extract some of the hydrocarbons from the oil. The resulting light hydrocarbon solvent is generally miscible with both the oil and the brine found in the reservoir.

Generally, as a miscible solvent passes through a reservoir, some of the oil is displaced in an accumulating oil bank in the path of the solvent, and some of the oil is dissolved in the solvent. The mixture of oil and solvent may be referred to as a miscible bank. As the miscible bank moves through the formation, it increases in oil content, and the outer boundary of the miscible bank may eventually be indistinguishable from the oil bank being displaced.

An advantage to the miscible solvent approach is that such solvents can generally wash oil from formations that might otherwise remain clinging to a formation if nonmiscible displacement fluids were used. In some applications, it may be desirable to conduct secondary or tertiary reservoir injections in stages. For example, an initial miscible solvent injection stage may be followed by subsequent sweeping stages where gasses or nonmiscible liquids are injected to displace the oil-enriched solvent that may remain in the formation.

Steam flooding is another technique that may be used to enhance recovery. With this technique, steam is injected into a reservoir to displace the oil and increase the reservoir temperature, thereby providing a decrease in the viscosity of the oil. Some of the steam diffusing into the reservoir may also serve to distill lighter hydrocarbon fractions from the oil, resulting in a miscible bank preceding the injected steam. In addition, some of the steam may form a nonmiscible displacement bank as it condenses to water. The advantages of steam flooding include relatively inexpensive production costs, and the fact that steam carries a large amount of heat per unit of mass.

Another method of enhancing recovery involves heating a reservoir at the site of a production well to create a heated zone of oil. The advantages of such processes may include higher reservoir pressure, lower oil viscosity, and causing the oil to swell due to heat effects. Such methods may be referred to in this respect as in situ heating methods. As an example, a heated production zone may be achieved by periodically injecting steam into the reservoir at the production well.

In general, recovery enhancement techniques can be used either individually, successively or in combination. However, typically even where secondary or tertiary recovery methods are implemented, there eventually comes a point when the production available from a well has diminished below a threshold economic level, and the costs of production are no longer justified. Such a situation may be exacerbated where the implementation of enhanced recovery methods has imposed a significant increase to production costs.

Thus, due to the economic balance between diminishing oil recovery and the expense of enhanced production, in many cases, well production may be discontinued where there is still a substantial amount of oil remaining in a reservoir, but it is simply too difficult or expensive to produce.

SUMMARY OF THE INVENTION

The invention features systems and methods of providing a subterranean fluid flow by radiating electromagnetic energy into a permeable formation.

In general, in one aspect, the subterranean fluid flow through the permeable formation is provided by positioning an electromagnetic device in a borehole of an applicator well and radiating electromagnetic energy into the permeable formation to vaporize material within the formation, thereby propagating a material displacement bank away from the applicator well and through the formation.

In another aspect, a subterranean fluid flow may be propagated to enhance oil recovery. In still another aspect, a subterranean fluid flow may be propagated to enhance gas recovery, including hydrocarbon gasses such as natural gas and methane, and non-hydrocarbon gasses such as sulfur. Additionally, in another aspect, a subterranean fluid flow may be propagated to provide subterranean material abatement.

Thus, the methods described above provide a significantly more effective and relatively inexpensive approach for providing a subterranean fluid flow. Moreover, the methods can be advantageously implemented in a wide variety of applications including, for example, enhanced oil or gas well recovery and pollution abatement.

Embodiments of each of the above aspects of the invention may include one or more of the following features. The methods may be applied in an autogenic manner. That is, the electromagnetic energy is provided into the reservoir without injecting external materials such as gases or liquids into the formation. Thus, the difficulty and expense of injecting external materials into a reservoir is eliminated. Another advantage of autogenic energy injection is that, because the reservoir volume is not artificially increased, cessations of energy injection may be used to provide increased control and even to reverse displacement bank propagation.

A production well, spaced away from the applicator well, is used to pump fluids from an enhanced pool formed by the displacement bank. In some applications, a formation pressure relief station is used to enhance the propagation of the displacement bank in a selected direction, for example, in the direction of the production well.

The radiated energy is modulated to maintain a selected applicator well temperature, Controlling the well temperature may be important so as not damage through overheating components of the electromagnetic device. The radiated energy may also be modulated to station an enhanced pool of subterranean fluid at a controllable distance from the applicator well, for example the distance between the applicator well and a production well.

A sealed casing may be used in the applicator well to protect the radiating device and to prevent fluid seepage into the applicator well. A parasitic reflector may be positioned in the path of the radiated energy to reflect the energy in a selected direction, thereby focussing or steering the radiated energy toward a desired target.

In another aspect of the invention, a system for generating a subterranean fluid flow through a permeable formation containing a material, includes a sealed casing sized and configured to be positioned within an applicator well and an antenna sized and configured to be positioned within the sealed casing and to radiate the electromagnetic energy into the permeable formation to vaporize a portion of the material. The sealed casing prevents fluid seepage into the applicator well and is formed of a material that is transmissive to the radiated electromagnetic energy.

Other advantages and features of the invention will be apparent from the following description and from the claims.

DETAILED DESCRIPTION

Figure 1:
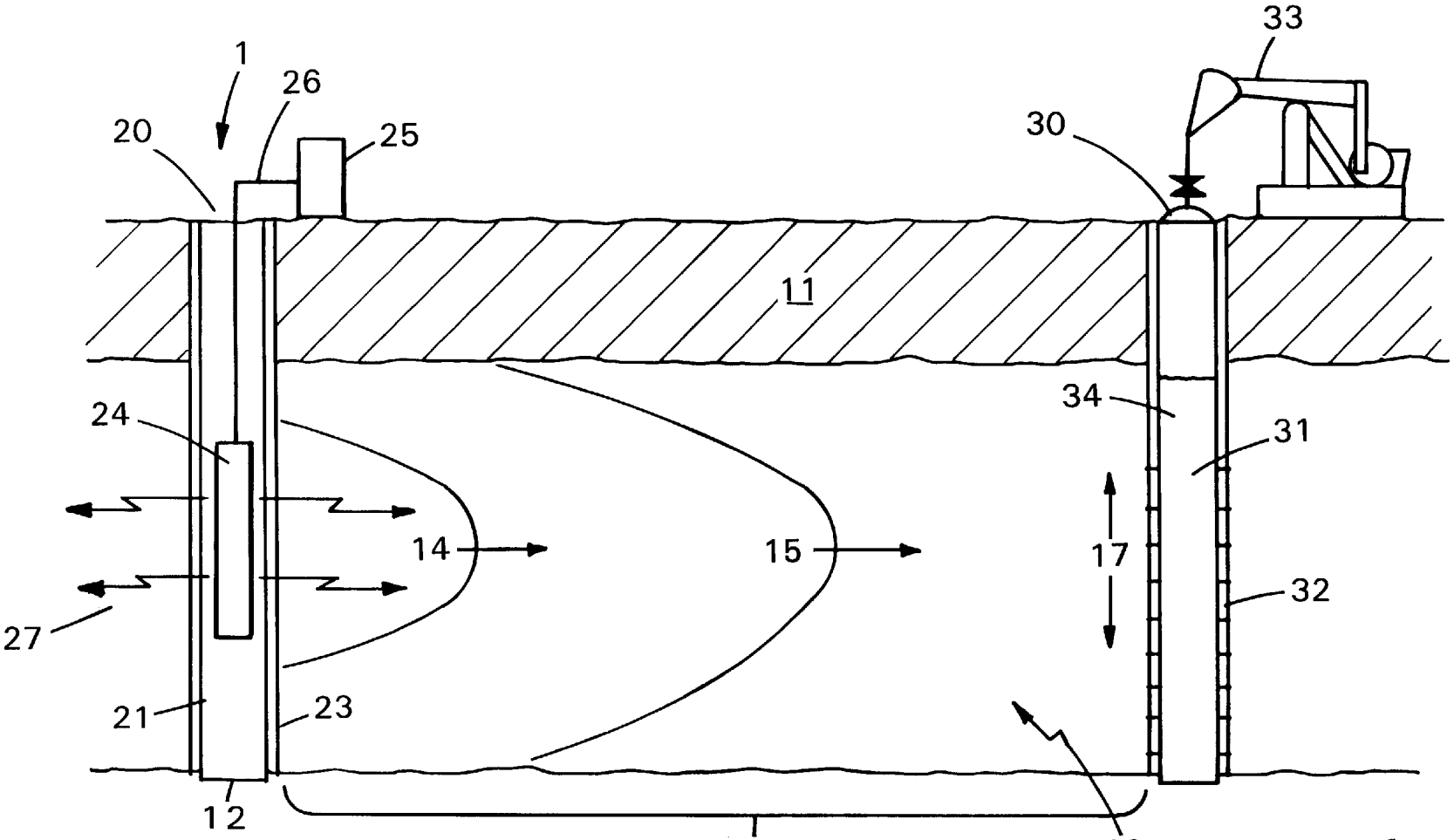
FIG. 1 is a schematic diagram of an autogenic system for enhanced oil recovery.
Figure 2:
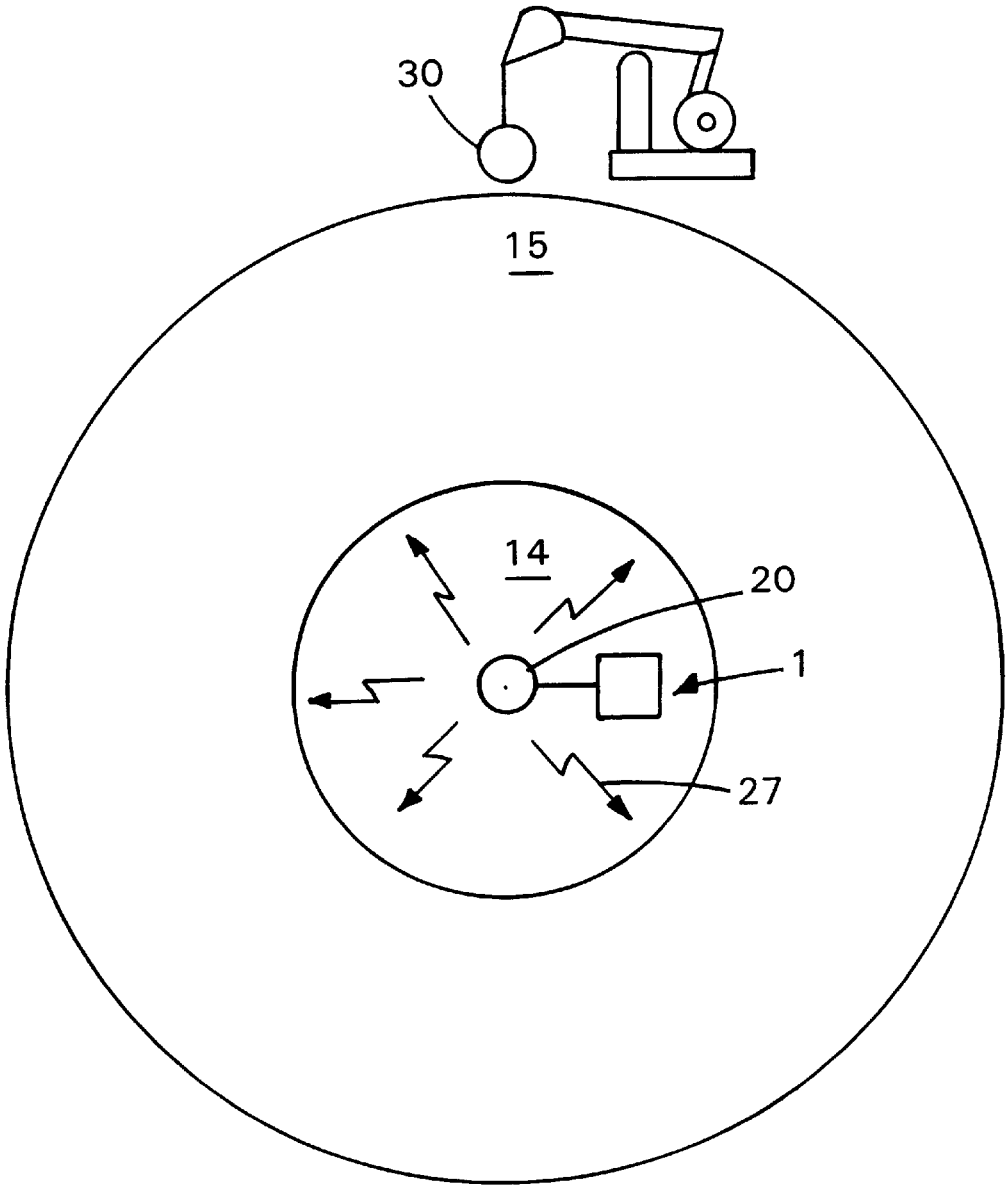
FIG. 2 is a schematic diagram of an oil field implementing the autogenic system of FIG. 1 for enhanced oil recovery.

Referring to FIGS. 1 and 2, an autogenic system 1 is shown for enhanced oil recovery in which an applicator well 20 is located in proximity to a production well 30. Both wells are drilled into a permeable formation 10 which extends from an overburden layer 11 to an underburden layer 12, enclosing an oil reservoir 13. While the wells 20 and 30 shown in FIGS. 1 and 2 are substantially vertical, the invention is also applicable to other well configurations, including angular and horizontal wells. In addition, in the context of the invention, the term "applicator well" is defined broadly to include any channel, tunnel or hole, either man-made or naturally occurring, of sufficient size and location with respect to a reservoir to facilitate the methods herein described.

In the example shown in FIG. 1, the borehole 31 of the production well 30 is supported by a perforated casing 32, and a pump 33 is used to extract the oil 34 that flows into the borehole 31 through the perforated casing 32. The borehole 21 of the applicator well 20 is supported by a sealed casing 23 to prevent seepage of reservoir fluids into the applicator well 20. An electromagnetic radiating device 24 is placed in the applicator well 20. A radio frequency (RF) generator 25 supplies energy to the device 24 through a coaxial cable 26. The sealed casing 23 is made from a material that is transmissive to the RF energy 27 radiated from the electromagnetic radiating device 24.

The RF energy 27 radiated into the formation 10 causes vaporization of water (not shown) near the applicator well 20, as well as dielectric heating of the formation 10 itself. The radial extent of the dielectric heating pattern may vary as a function of the operating frequency, power, the length of the RF antenna 24, and the electrical conductivity and dielectric constant of the dielectric media in the path of the RF energy 27. As steam is generated, the reservoir oil 13 is displaced away from the applicator well 20. Some of the generated steam diffuses into the reservoir oil 13, extracting hydrocarbon fractions from the oil and forming a miscible bank 15. Thus, radiation of the RF energy 27 into the formation 10 results in part in a steam flood type oil displacement.

In addition, the increased reservoir temperature results in off-gassing of light hydrocarbons from the reservoir oil 13, thus providing a gas drive type displacement effect that may form the miscible bank 15 as such hydrocarbons diffuse into the reservoir oil 13. The effectiveness of the gas drive is enhanced from pressure resulting from steam generated between the gas bank (not shown) and the applicator well 20. It will be appreciated that, depending on the reservoir composition, the resulting increase in reservoir temperature may also result in the off-gassing of non-hydrocarbon reservoir components such as sulfur.

FIGS. 1 and 2 represent one particular application of autogenic system 1, in which the system was applied in oilfields of the Sundance/Moorcroft region in Wyoming. Applicator well 20 is located about 400 ft away from production well 30. The characteristics of the reservoir 13 between wells 20 and 30 may be summarized as follows: the formation 10 consists primarily of sand with a permeability of about 1 Darcy; the reservoir payzone 17 has a vertical range of about 20 to 30 ft; the ambient temperature of the reservoir 13 is about 12° C.; the average pressure of the reservoir 13 is about 700 psi; and the oil in the reservoir 13 is generally sweet with an average viscosity varying from 100 to 1000 Centipoise. Prior to implementation of the autogenic enhancement process, the fluids recovered from the production well 30 include about 50% water, and the available production from the production well 30 is about 5 barrels of oil per day.

The electromagnetic radiating device 24 was placed at a depth of 600 ft in the applicator well 20, at a location approximately in the middle of the vertical payzone range 17. RF energy 27 was radiated at a power of 10 kilowatts (KW), and a frequency of 27.12 megahertz (MHz). When the temperature at the applicator well 20 reached about 140° C., the radiation power was cycled down to 8 to 9 KW, typically for a period of several hours, until the temperature of the applicator well 20 cooled to about 130° C., and then the power was cycled back to 10 KW. The cycling of radiation power may be referred to generally as modulating the power, or modulating the radiation energy. Such modulation may also include cessation of the process.

It will be appreciated that the applicator well target temperatures implemented in the process may be selected to accommodate the temperature tolerance of apparatus components (e.g., a 150° C. tolerance of the coaxial cable 26). For example, a radiating antenna with a high temperature tolerance might be used to maintain a high applicator well temperature, e.g., 500° C. It will also be appreciated that the frequency of the radiated energy 27 may be selected according to FCC regulations, and according to principles well known in the art, including the dielectric heating characteristics of particular media. According to the selected frequency of the radiated energy 27, the energy 27 may include radio frequency energy and microwave energy. In this context, radio frequency energy has a frequency in a range between 300 kilohertz (KHz) and 300 MHz, and microwave energy has a frequency in a range between 300 MHz and 300 gigahertz (GHz).

After two weeks of continuous radiating, a miscible bank 15 had formed around the applicator well 20, propagating outward at a rate of about 5 to 20 ft per day. With continued radiation, the miscible bank 15 continued expanding, creating a heated zone within the reservoir (not shown). As the miscible bank 15 approached the production well 30, oil recovery at the production well rose and continued to rise after the miscible bank 15 enveloped the production well 30. In this example, the increase in recovery at the production well 30 occurred in spikes, similar to the production characteristics of many newly drilled wells, and to "huff and puff" type production behavior.

In this example, the radiation 27 from the antenna 24 was ceased, and the miscible bank 15 began collapsing back toward the applicator well 20 with the outer edge retreating at a rate of about 5 to 20 ft per day. Radiation was resumed as before, and the miscible bank 15 again expanded from the applicator well 20 at a rate of about 5 to 20 ft per day. It will thus be appreciated that the radiating may be modulated to maintain an outer edge of the displacement bank 15 at a controllable distance from the applicator well 20. This modulation may be conducted to optimize production rates which may correspond to the position and size of the miscible bank 15.

After about one month of continuous radiation, the process resulted in approximately 300% of increased recovery at the production well 30 positioned about 400 ft from the applicator well 20. Analysis of the oil 34 produced at the production well 30 revealed a significantly elevated gas content. It was also observed that one effect of the process in this example was to create a dry zone 14 about the applicator well 20 which contained no significant amount of oil or water. The dry zone 14 was found to extend outward from the applicator well 20 to a radius of at least about 5 ft.

It will be appreciated that the process described in FIGS. 1 and 2 may be conducted as part of a larger operation involving multiple applicator wells to further enhance a production pool. For example, four applicator wells could spaced apart in a square matrix and operated to enhance recovery from a production well positioned in the center of the applicator well matrix.

It will be further appreciated that the process discussed with respect to FIGS. 1 and 2 may have applications in other fields such as subterranean material abatement. In this context, material abatement refers to processes where a material is removed from the ground, such as pollution abatement and mining. Thus, the methods provided may be used to enhance recovery of organic and inorganic materials from the ground. Such materials removed from the ground may be referred to as abatement materials.

Figure 3:
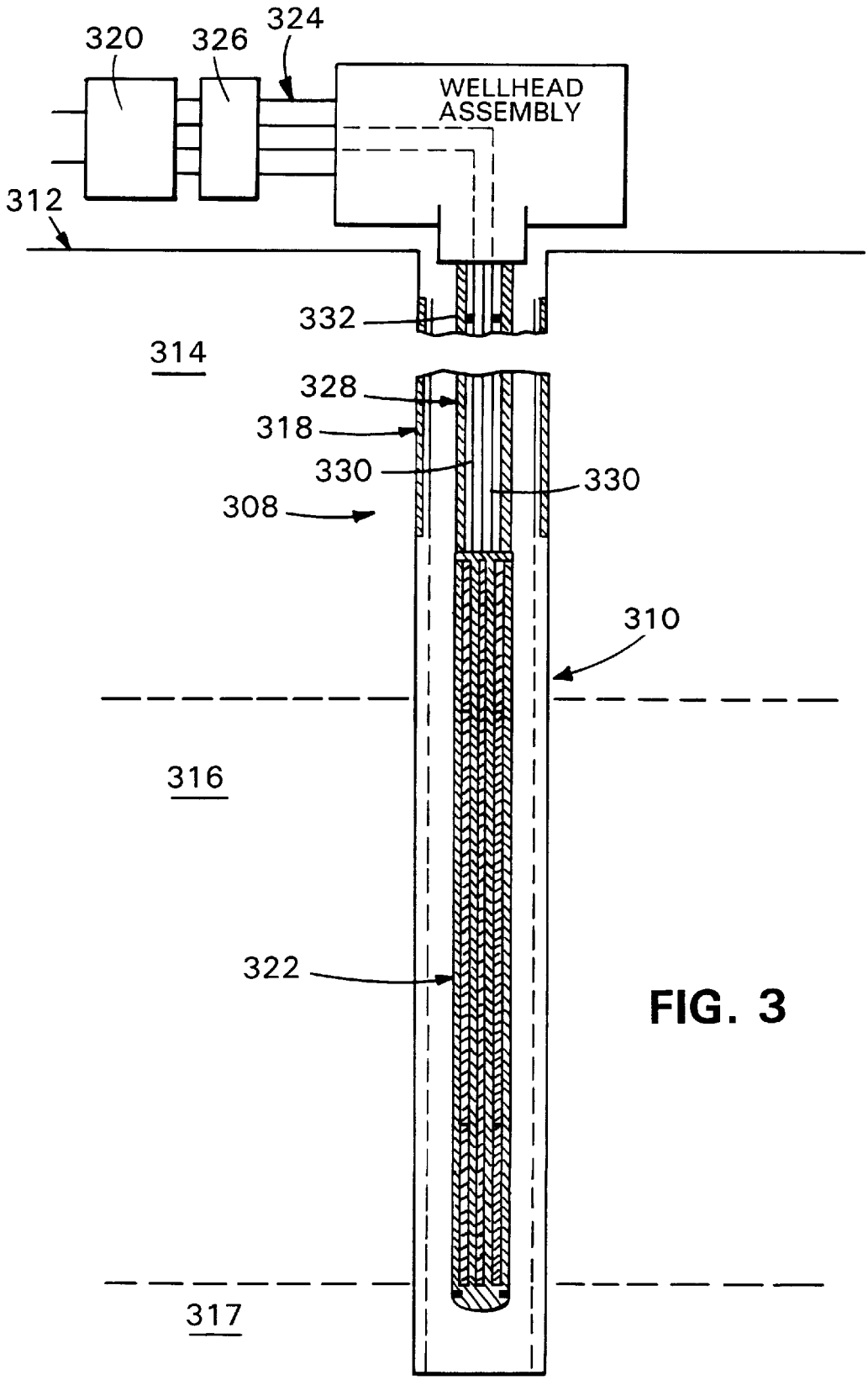
FIG. 3 is a schematic diagram of an exemplary electromagnetic device suitable for use as part of the autogenic system for enhancing oil recovery.

Referring to FIG. 3, a diagram is provided of an electromagnetic device 308, here a borehole antenna apparatus, suitable for use in the process discussed with respect to FIGS. 1 and 2. A borehole 310 is drilled into the earth to extend from the earth's surface 312 through an overburden layer 314 and into the region of a subsurface formation from which organic and inorganic materials are to be recovered (the "reservoir" 316). The reservoir 16 overlies an underburden 317.

The borehole 310 is cased with a casing 318. The casing 318 may be comprised of individual lengths joined together and cemented in place in borehole 310. The casing 318 is made from a radiation transparent material that can withstand a relatively moderate temperature environment (that is, on the order of 100 to 200° C.). For example, the casing 318 may be made from fiberglass, polyvinyl chloride (PVC), ceramic, or concrete. In this context, radiation transparent material refers to any material that will not substantially block the radiation necessary for this process. The casing 318 may extend from the well head through reservoir 316 and underburden 317 to the bottom of borehole 310. Further, the collective casing may be sealed to prevent seepage of fluids from the reservoir 316 into the borehole 310.

A high power RF generator 320 transmits electromagnetic energy to a downhole radiating antenna over either a flexible or semi-rigid coaxial transmission line 324. The antenna is shown in the form of a collinear antenna array 322 having three antennas fabricated from a coaxial transmission line comprising an inner conductor and an outer coaxial conductor with an impedance matching element. The antenna 322 has a length of about 10 ft. The RF generator 320, which is generally located on the earth's surface, is coupled to a coaxial transmission line 324 by coaxial liquid dielectric impedance matching transformer 326. The outer conductor 328 of the coaxial transmission line 324 is a hollow tubular member, and the inner conductor 330 is a hollow tubular member of smaller diameter which is continuous through collinear array antenna 322. Outer conductor 328 of coaxial transmission line 324 and inner conductor 320 are spaced and insulated from one another by insulating spacers 332 (for example, ceramic discs). Multiple sections of coaxial transmission line 324 are coupled together in borehole 310 to form a string having sufficient length to reach reservoir 316.

The collinear array antenna 322, which may be based on the collinear antenna array disclosed in Kasevich et al., U.S. Pat. No. 4,700,716, incorporated herein by reference, can operate at a selected frequency in the range of between about 100 KHz to about 2.45 GHz. It will be appreciated other well-known antenna designs could be used in the process, and thus the invention is not limited to the type of antenna that is used. For example, transmitting antennas may be used that are based on Kasevich, U.S. patent application Ser. No. 09/248,170, incorporated herein by reference. Specifically, the choice of transmitting antenna need not be limited to collinear array designs. It will also be appreciated that other devices which are capable of radiating electromagnetic energy such as an open-ended transmission line could be used to transmit the electromagnetic energy.

Figure 4:
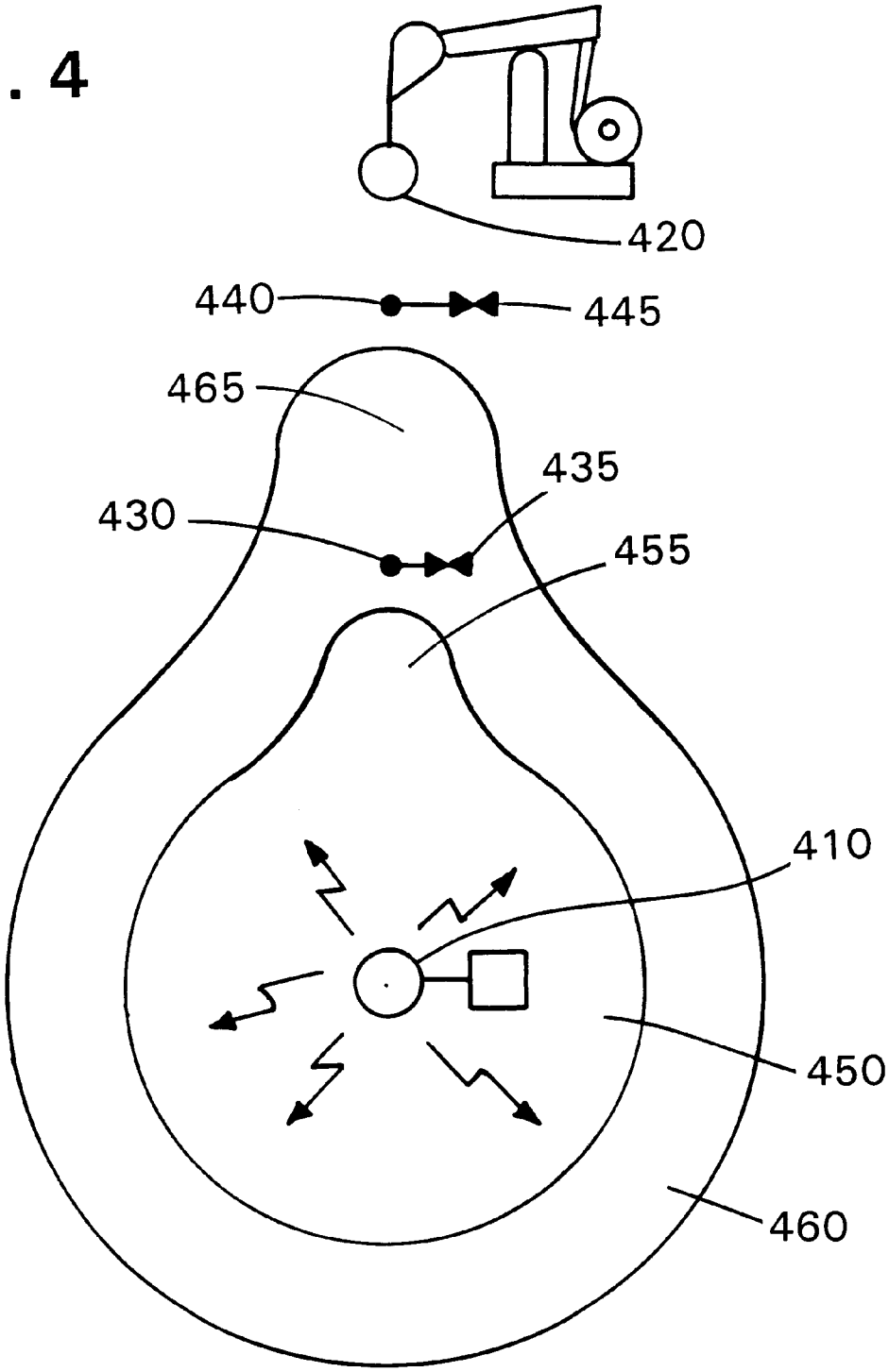
FIG. 4 is a schematic diagram of an oil field implementing an autogenic system for enhanced oil recovery including pressure relief stations.

Referring to FIG. 4, a diagram of an oilfield is shown where an applicator well 410 is used to propagate an oil displacement bank in the direction of a production well 420, by an autogenic process similar to the processes discussed with respect to FIGS. 1 and 2. In the example shown in FIG. 4, reservoir pressure relief stations 430 and 440 are used to enhance a directional propagation of the displacement bank.

Reservoir pressure relief stations 430 and 440 are wells drilled into the reservoir, and are equipped with pressure relief valves 435 and 445. Stations 430 and 440 are positioned generally between the applicator well 410 and the production well 420. As the autogenic energy injection process is conducted, valve 435 may be opened to release natural pressure from the reservoir, and to release the increased pressure resulting from the process. By bleeding reservoir pressure from station 430, a pressure differential in the reservoir may be created that enhances fluid flow in the direction of station 430.

For example, the process may propagate a hydrocarbon gas displacement bank 450 from the applicator well 410, and the low pressure zone at station 430 with valve 435 opened may enhance the flow of the displacement bank 450 in the direction of the station 430. Thus, the propagation of the displacement bank 450 may be relatively greater at a location 455 corresponding to the position of the station 430. As the displacement bank 450 reaches the location of station 430, the valve 435 may be closed to preserve reservoir pressure, and another station such as station 440 may be used in a similar manner to produce a further propagated displacement bank 460, that has a relatively greater propagation at a location 465 corresponding to the position of the station 450. It will be appreciated that in the location and operation such pressure relief stations may be selected to accommodate varying production objectives, such as enhancing flow to multiple production wells and accommodating particular formation features such as faults and channels.

Figure 5:
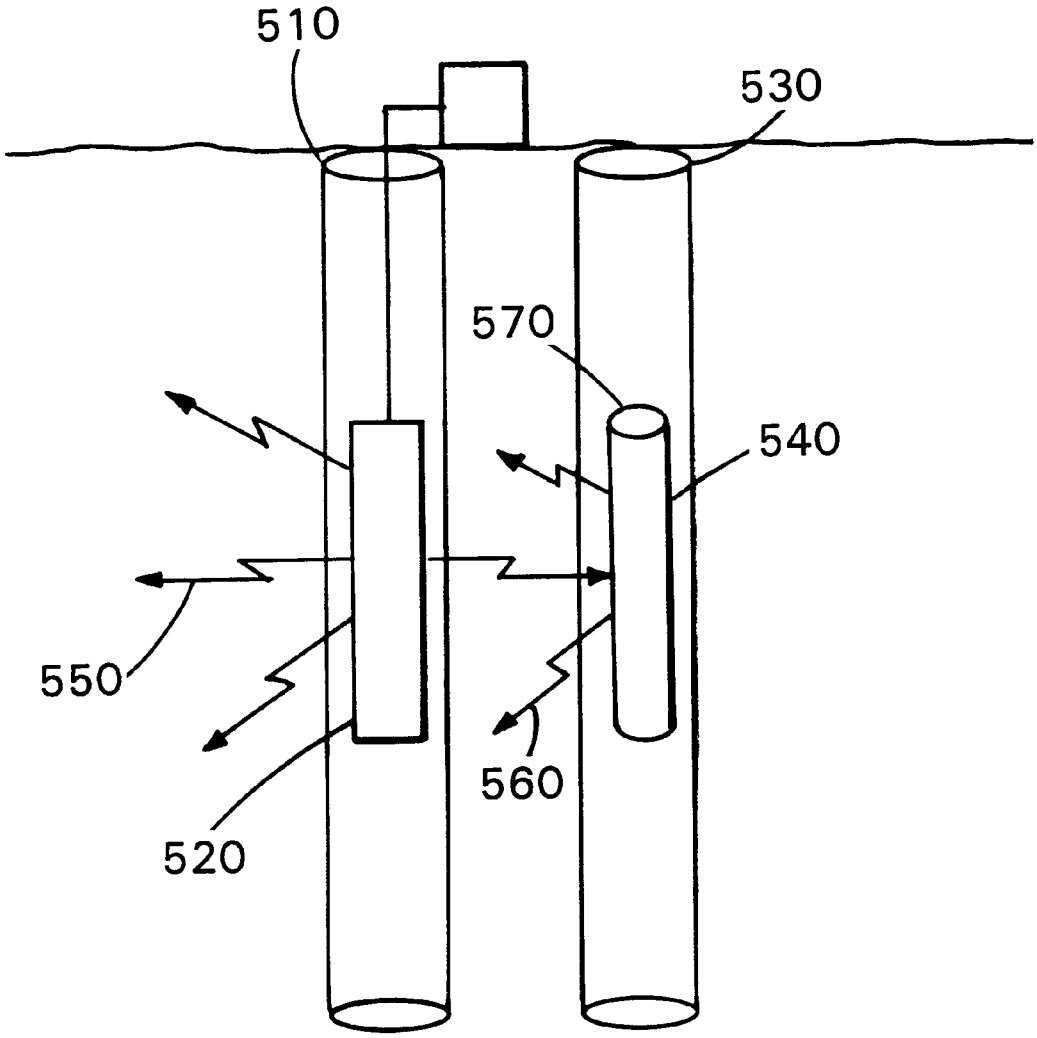
FIG. 5 is a schematic diagram of an applicator well antenna provided with a parasitic reflector element.

Referring to FIG. 5, a radiating device 520 is shown positioned within an applicator well 510 provided with a passive, parasitic reflecting element 540. In this example, the reflecting element 540 is a hollow tube made of an electromagnetic conductive material. The reflecting element 540 is positioned in reflector well 530 to an effective reflecting position 570 with respect to device 550. The position 570 represents a distance between the reflector 540 and the device 520 of about one quarter of the wavelength of the energy 550 radiated by the device 520.

In general, the reflecting element 540 is positioned in the path of the energy 550 radiated from the radiating device 520, and serves to direct a portion of the radiated energy in a reflected direction 560 away from the reflecting element 540. For example, this relationship may be selected according to the teachings of Kasevich, U.S. patent application Ser. No. 09/248,170.

It will be appreciated that by using the reflecting element 540 to direct a portion of the radiated energy in a selected direction, the shape and direction of the propagating displacement bank may be affected to accommodate production objectives.

The above description of the invention is illustrative and not limiting. Other embodiments of the invention are within the following claims.

What is claimed is:

1. A method for providing a subterranean fluid flow through a permeable formation, comprising:

drilling an applicator well into a permeable formation containing a material;

placing an electromagnetic device in the applicator well;

autogenically operating the electromagnetic device to radiate energy into the permeable formation to vaporize a portion of the material; and sustaining autogenic operation of the electromagnetic device to propagate a material displacement bank including hydrocarbon material away from the applicator well.

2. The method of claim 1, further comprising using a production well having a position in the path of the fluid flow from the applicator well to pump fluids from an enhanced pool formed by the fluid flow.

3. The method of claim 1, further comprising modulating the energy radiated from the electromagnetic device to maintain an applicator well temperature between 100° C. and 200° C.

4. The method of claim 1, further comprising modulating the energy to station an outer boundary of the material displacement bank at a controllable distance from the applicator well.

5. The method of claim 1, further comprising providing the borehole of the applicator well with a sealed casing formed of a radiation transparent material to prevent fluid seepage into the applicator well.

6. The method of claim 1, further comprising placing a parasitic reflector in a path of the radiated energy to direct a portion of the radiated energy in a reflected direction.

7. The method of claim 1, wherein the radiated energy is in a frequency range between 300 KHz and 300 GHz.

8. The method of claim 7, wherein the frequency range is between 10 MHz and 100 MHz and the radiated energy has a power level between 8 and 12 KW.

9. The method of claim 1, wherein the applicator well is substantially vertical.

10. The method of claim 1, wherein the permeable formation contains water and oil and the method further comprises sustaining the level of energy to vaporize the water to provide a steam flood for driving an oil flow away from the applicator well.

11. The method of claim 10, wherein a resulting reservoir temperature increase propagates an evaporated hydrocarbon gas displacement bank.

12. The method of claim 11, further comprising using a reservoir pressure relief station to reduce a pressure of a fluid reservoir within the permeable formation at a selected location to cause an enhanced directional propagation of the material displacement bank.

13. The method of claim 1, wherein the electromagnetic device is an antenna array for radiating energy at a frequency in a range between 1 MHz and 100 MHz and a power level in a range between 8 and 12 KW.

14. The method of claim 1, further comprising using a pattern of multiple applicator wells, each having an antenna which in operation radiates electromagnetic energy in the reservoir to form the enhanced pool.

15. A method for providing enhanced recovery subterranean material, comprising:

placing an antenna down a borehole of an applicator well;

operating the antenna autogenically to radiate a level of energy into a permeable formation containing water and the subterranean material;

sustaining the level of energy autogenically to vaporize the water and provide a steam flood for driving a flow of the subterranean material away from the applicator well; and using a production well in the path of the abatement material flow to recover the subterranean material from an enhanced subterranean material pool.

16. The method of claim 15, further comprising using a reservoir pressure relief station to reduce a pressure of a fluid reservoir within the permeable formation at a selected location to cause an enhanced directional propagation of the material displacement bank.

17. The method of claim 15, further comprising modulating the energy radiated from the antenna to maintain an applicator well temperature between 100° C. and 200° C.

18. The method of claim 15, further comprising modulating the energy to station an outer boundary of a resulting displacement bank at a controllable distance from the applicator well.

19. The method of claim 15, further comprising providing the borehole of the applicator well with a sealed casing formed of a radiation transparent material to prevent fluid seepage into the applicator well.

20. The method of claim 15, wherein the applicator well is substantially vertical.

21. The method of claim 15, further comprising placing a parasitic reflector in a path of the radiated energy to direct a portion of the radiated energy in a reflected direction.

22. The method of claim 15, further comprising using a pattern of multiple applicator wells, each having an antenna which in operation radiates electromagnetic energy in a material zone to form the enhanced subterranean material pool.

23. A method of stationing an enhanced pool of subterranean fluid about the site of a production well, comprising:

using an energy injection well to radiate energy into a subterranean fluid reservoir;

radiating a level of energy into the reservoir to propagate a displacement bank; and modulating the level of energy to station an outer boundary of the displacement bank at a controllable distance from the energy injection well.

24. A method for providing a steerable subterranean fluid flow, comprising:

using an electromagnetic device in a borehole of an applicator well to radiate energy into a fluid reservoir in a permeable formation to vaporize a material within the reservoir to propagate a material displacement bank; and using a reservoir pressure relief station to reduce a pressure of the reservoir at a selected location to cause an enhanced directional propagation of the material displacement bank.

25. A system for generating a subterranean fluid flow through a permeable formation containing a material, comprising:

a sealed casing sized and configured to be positioned within an applicator well and to prevent fluid seepage into the applicator well, the sealed casing formed of a material that is transmissive to electromagnetic energy;

an antenna sized and configured to be positioned within the sealed casing and to radiate the electromagnetic energy into the permeable formation to vaporize a portion of the materials and a directing element configured to direct a portion of the electromagnetic energy radiated by the antenna in a desired direction.

26. The system of claim 25, further comprising a production well having a position in the path of the fluid flow from the applicator well to pump fluids from an enhanced pool formed by the fluid flow.

27. The system of claim 25, wherein the antenna is configured to modulate the energy radiated from the antenna to maintain an applicator well temperature between 100° C. and 200° C.

28. The system of claim 25, further comprising a parasitic reflector disposed in a path of the radiated electromagnetic energy to direct a portion of the radiated energy in a reflected direction.

29. The system of claim 25, wherein the antenna is configured to radiate the electromagnetic energy in a frequency range between 10 MHz and 100 MHz and at a power level between 8 KW and 12 KW.

30. The system of claim 25, further comprising:

a plurality of sealed casings, each casing sized and configured to be positioned within an applicator well and to prevent fluid seepage into the applicator well, each sealed casing formed of a material that is transmissive to electromagnetic energy;

a corresponding plurality of antennas, each antenna sized and configured to be positioned within the sealed casing and to radiate the electromagnetic energy into the permeable formation to vaporize a portion of the material;

each of said casings and corresponding antennas positioned to radiate electromagnetic energy in a direction to form an enhanced pool.

31. A system for generating a subterranean fluid flow through a permeable formation containing a material, the system comprising:

a sealed casing sized and configured to be positioned within an applicator well and to prevent fluid seepage into the applicator well, the sealed casing formed of a material that is transmissive to electromagnetic energy;

an antenna sized and configured to be positioned within the sealed casing and to radiate the electromagnetic energy into the permeable formation to vaporize a portion of the material; and a reservoir pressure relief station to reduce a pressure of a fluid reservoir within the permeable formation at a selected location to cause an enhanced directional propagation of the material displacement bank.

32. A method for providing a subterranean fluid flow through a permeable formation, comprising:

drilling an applicator well into a permeable formation containing a material;

placing an electromagnetic device in the applicator well;

operating the electromagnetic device to radiate energy into the permeable formation to vaporize a portion of the material;

sustaining operation of the electromagnetic device to propagate a material displacement bank away from the applicator well; and positioning a directing element in a path of the radiated energy to direct a portion of the radiated energy in a desired direction.

33. The method of claim 32, further comprising using a production well having a position in the path of the fluid flow from the applicator well to pump fluids from an enhanced pool formed by the fluid flow.

34. The method of claim 32 further comprising modulating the energy radiated from the electromagnetic device to maintain an applicator well temperature between 100 EC and 200 EC.

35. The method of claim 32 further comprising modulating the energy to station an outer boundary of the material displacement bank at a controllable distance from the applicator well.

36. The method of claim 32 further comprising providing the borehole of the applicator well with a sealed casing formed of a radiation transparent material to prevent fluid seepage into the applicator well.

37. The method of claim 32 wherein the radiated energy is in a frequency range between 300 KHz and 300 GHz.

38. The method of claim 37, wherein the frequency range is between 10 MHz and 100 MHz and the radiated energy has a power level between 8 and 12 KW.

39. The method of claim 32 wherein the permeable formation contains water and oil and the method further comprises sustaining the level of energy to vaporize the water to provide a steam flood for driving an oil flow away from the applicator well.

40. The method of claim 39 wherein a resulting reservoir temperature increase propagates an evaporated hydrocarbon gas displacement bank.

41. The method of claim 40 further comprising using a reservoir pressure relief station to reduce a pressure of a fluid reservoir within the permeable formation at a selected location to cause an enhanced directional propagation of the material displacement bank.

42. A method for providing a subterranean fluid flow through a permeable formation, comprising:

drilling an applicator well into a permeable formation containing a material;

placing an electromagnetic device in the applicator well;

operating the electromagnetic device to radiate energy into the permeable formation to vaporize a portion of the material;

sustaining operation of the electromagnetic device to propagate a material displacement bank away from the applicator well; and using a reservoir pressure relief station to reduce a pressure of a fluid reservoir within the permeable formation at a selected location to cause an enhanced directional propagation of the material displacement bank.

43. The method of claim 42, further comprising using a production well having a position in the path of the fluid flow from the applicator well to pump fluids from an enhanced pool formed by the fluid flow.

44. The method of claim 42 further comprising modulating the energy radiated from the electromagnetic device to maintain an applicator well temperature between 100 EC and 200 EC.

45. The method of claim 42 further comprising modulating the energy to station an outer boundary of the material displacement bank at a controllable distance from the applicator well.

46. The method of claim 42 further comprising providing the borehole of the applicator well with a sealed casing formed of a radiation transparent material to prevent fluid seepage into the applicator well.

47. The method of claim 42 wherein the radiated energy is in a frequency range between 300 KHz and 300 GHz.

48. The method of claim 47, wherein the frequency range is between 10 MHz and 100 MHz and the radiated energy has a power level between 8 and 12 KW.

49. The method of claim 42 wherein the permeable formation contains water and oil and the method further comprises sustaining the level of energy to vaporize the water to provide a steam flood for driving an oil flow away from the applicator well.

50. The method of claim 49 wherein a resulting reservoir temperature increase propagates an evaporated hydrocarbon gas displacement bank.

* * * * *